US006478613B1

(12) United States Patent
Zoell et al.

(10) Patent No.: US 6,478,613 B1
(45) Date of Patent: Nov. 12, 2002

(54) CONNECTOR FOR A FUEL PUMP OF A MOTOR VEHICLE

(75) Inventors: Jürgen Zoell, Deutschland (DE); Ralf Muehlhausen, Deutschland (DE)

(73) Assignee: Mannesmann Vdo A.G., Frankfurt am Main (DE)

( * ) Notice: Subject to any disclaimer, the term of this patent is extended or adjusted under 35 U.S.C. 154(b) by 0 days.

(21) Appl. No.: 09/743,569

(22) PCT Filed: May 2, 2000

(86) PCT No.: PCT/EP00/03919

§ 371 (c)(1),
(2), (4) Date: Feb. 26, 2001

(87) PCT Pub. No.: WO00/68561

PCT Pub. Date: Nov. 16, 2000

(30) Foreign Application Priority Data

May 11, 1999 (DE) ..... 199 21 539

(51) Int. Cl.[7] ..... H01R 13/52
(52) U.S. Cl. ..... 439/519; 439/936; 417/410.1
(58) Field of Search ..... 439/519, 936; 417/410.1

(56) References Cited

U.S. PATENT DOCUMENTS

| | | | | |
|---|---|---|---|---|
| 4,845,393 A | | 7/1989 | Burgess et al. | |
| 5,013,222 A | | 5/1991 | Sokol et al. | |
| 5,141,410 A | | 8/1992 | Fujii | |
| 5,305,903 A | | 4/1994 | Harde | |
| 5,326,273 A | * | 7/1994 | Kamon et al. | 439/519 |
| 5,427,263 A | | 6/1995 | Bowles | |
| 5,428,883 A | * | 7/1995 | Stieglitz | 29/602.1 |
| 5,634,597 A | * | 6/1997 | Krohn et al. | 239/585.5 |
| 5,669,763 A | | 9/1997 | Pryce et al. | |
| 5,697,769 A | | 12/1997 | Kobman et al. | |
| 6,059,382 A | * | 5/2000 | Schoettl | 303/119.3 |

FOREIGN PATENT DOCUMENTS

| | | |
|---|---|---|
| DE | 90 05 151 | 8/1990 |
| DE | 41 01 869 A1 | 7/1992 |
| DE | 195 11 073 A | 9/1996 |
| GB | 1594873 | 8/1981 |

* cited by examiner

*Primary Examiner*—Tho D. Ta
(74) *Attorney, Agent, or Firm*—Richard A. Speer; Mayer, Brown, Rowe & Maw

(57) ABSTRACT

Connectors for fuel pumps in motor vehicles have fuel flowing around them. Apart from the connections for the electrical supply lines, such connectors make contact with further electrical components. Corrosive components in fuels attack the connecting points of the connector to the electrical components, so that this can lead to failure of the fuel pump. The new connector is intended to have connecting points which are no longer attacked by the fuel. By extrusion coating parts of the connector with plastic, the connecting points are effectively protected against attack by fuel. Recesses in the plastic extrusion coating allow fuel to still flow around parts of the connector for cooling, while the regions of the connector which are at risk are separated from the fuel.

5 Claims, 1 Drawing Sheet

CONNECTOR FOR A FUEL PUMP OF A MOTOR VEHICLE

BACKGROUND OF THE INVENTION

The invention relates to a connector for a fuel pump in a motor vehicle, in order to allow the fuel pump to make contact with the electrical supply lines. As a rule, such fuel pumps are arranged in the fuel tank in the motor vehicle, in order to feed the fuel from the fuel tank to the internal combustion engine.

Known fuel pumps have one or two pump stages, which are driven by an electric motor. The known fuel pumps are in this case designed such that the pump stage is arranged at the lower end in a physical mounting for the fuel pump. The pump stage is connected to an electric motor, and a bearing plate together with the connector (which is arranged outside the housing of the fuel pump) forms the upper closure of the fuel pump. Apart from the contact pins for the plug connection and the connections for the electric motor, the connector comprises a ground connection, inductances and capacitances for interference suppression, and carbon brushes for the electric motor. The carbon brushes, which are arranged in separate receptacles in the bearing plate, each make contact with the connector via a braid. The individual components of the connector are connected to one another either by plug connections, weld points or solder points. Since the fuel pump is arranged in the fuel tank, fuel flows around the connector. Fuels are corrosive media, which attack the connecting points of the connector. Particularly if the fuel contains methanol or ethanol, the connecting points are attacked in such a manner that they are destroyed in the long term, thus leading to failing of the fuel pump.

BRIEF SUMMARY OF THE INVENTION

The invention is based on the object of providing a connector for a fuel pump which is arranged in a fuel tank and whose life is independent of the fuel used. It is intended to be possible to produce such a connector in a simple manner and economically.

According to the invention, the object is achieved by the features of claim 1. Advantageous refinements are described in the dependent claims.

The object is achieved in that parts of the connector, in particular the connecting points, are extrusion coated with plastic. This means that the connecting points no longer come into contact with the fuel, and are thus protected against long-term destruction by the corrosive components of the fuel. The advantage of the connector according to the invention is that extrusion coating with plastic is very economical, and the connector is thus effectively protected without any major cost.

It is advantageous to extrusion coat only individual regions of the connector. This reduces the amount of material used for extrusion coating. In consequence, the volume of the connector is not unnecessarily increased, so that the connector is physically relatively small. Furthermore, it is possible to exploit the advantages of a connector around which fuel flows. It is thus advantageous not to extrusion coat the inductances. Excessive heating of the inductances is prevented by fuel flowing around them during operation of the fuel pump.

In the same way, the capacitor need not be extrusion coated since it already has a fuel-resistant sheath. In another advantageous refinement, the capacitor is extrusion coated.

This allows the use of a capacitor which is not sheathed, and is thus less expensive. In consequence, the connector according to the invention can be produced economically.

The braids of the carbon brushes are welded to the connector. In order to protect the connecting points, they and a portion of the braids are likewise extrusion coated with plastic. During the spraying process, the plastic is applied at a very high pressure in order to ensure that the plastic, which is made to be fluid for this process, fills the entire spraying tool, thus achieving high reproduction accuracy. However, since the plastic is at high pressure, there is a risk that it will penetrate into the braid. Sharp edges can be formed between the individual wires in the braid by the plastic which has penetrated into them and has solidified. This results in a precise bending point so that, if the braid is subjected to long-term bending stress, this can lead to the individual wires being broken. This damage to the braid can lead to the braid fracturing. This risk is advantageously avoided in that the braid is mechanically compressed in the region to be extrusion coated. This compression process reduces the size of the cavities between the wires in the braid, so that no plastic can penetrate into them.

In another advantageous refinement, the braids can also be extrusion coated without mechanical compression, if the braids are surrounded by a fuel-resistant sealing element in the region of the edge of the plastic. This sealing element may, for example, be a metal sleeve.

However, surprisingly, it has been found that it is sufficient to extrusion coat the braids even without any mechanical compression or sealing element, since the braid is mainly moved only during installation and only a small amount of movement capability is required throughout the life of the fuel pump arising from the wear resulting from the repositioning of the carbon brushes which are connected to it.

It has been found to be particularly advantageous to use polyoxymethylene as the plastic for extrusion coating.

In a further advantageous refinement, the extrusion-coated plastic is formed in such a way that it has forming elements. These forming elements may be latching and connecting elements or sealing surfaces of the plug connection, or else holding elements. These forming elements also allow automatic assembly of the connector with the bearing plate.

The ground contact is advantageously a metal spring, which is likewise extrusion coated with plastic at its connecting point to the connector.

DESCRIPTION OF THE DRAWINGS

The invention will be explained in more detail with reference to an exemplary embodiment. In this case, in the figures.

DETAILED DESCRIPTION OF THE INVENTION

Figure 1:
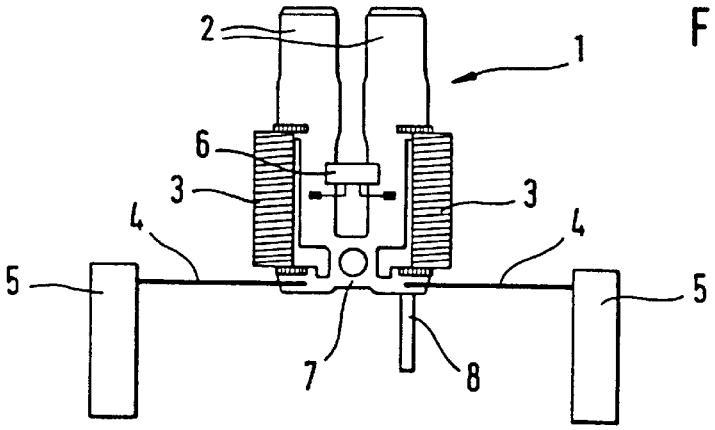
FIG. 1 shows a connector for a fuel pump without extrusion coating.

The connector 1 illustrated in FIG. 1 comprises two contact pins 2, two coils 3 which are each welded onto a contact pin 2, and carbon brushes 5 which are connected to the contact pins 2 via copper braids 4. The copper braids 4 are likewise welded to the contact pins 2. Furthermore, a capacitor 6, which is not sheathed, is welded to the connector 1. In order to allow the connector 1 to be handled better during the production process, the contact pins 2 are connected at their lower end by means of a web 7. The metal spring is welded to one of the contact pins 2, as a ground contact 8.

Figure 2:
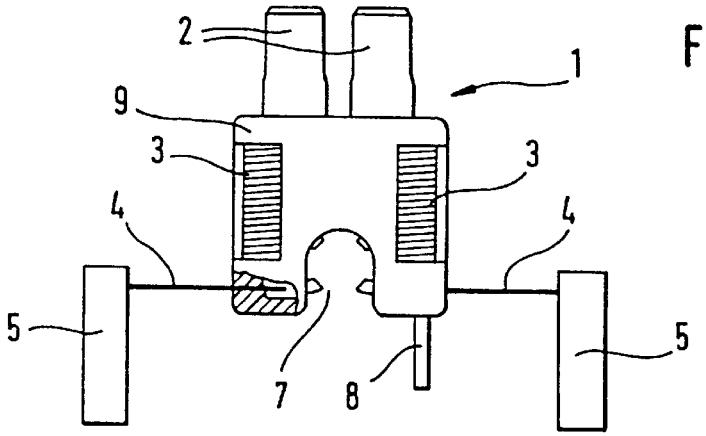
FIG. 2 shows a connector for a fuel pump with extrusion coating.

In FIG. 2. portions of the contact pins 2, of the coils 3, of the copper braids 4, of the metal spring 8 and of the capacitor 6 in the connector 1 shown in FIG. 1 are extrusion coated with plastic with polyoxymethlene 9, and are thus effectively protected against attack by fuel. In the region of the coils 3, recesses are arranged in the polyoxymethlene 9 in such a manner that the turns of the coils 3 are exposed. Fuel can thus still flow around the turns, in order to cool the coils 3. After the extrusion coating process, the web 7 between the contact pins 2 is cut through, so that the two contact pins 2 are electrically isolated from one another. All the connecting points are extrusion coated with polyoxymethylene 9, and are thus effectively protected against attack by fuel. In the region of the coils 3, recesses are arranged in the polyoxymethylene 9 in such a manner that the turns of the coils 3 are exposed. After the extrusion coating process, the web 7 between the contact pins 2 is cut through, so that the two contact pins 2 are electrically isolated from one another.

Figure 3:
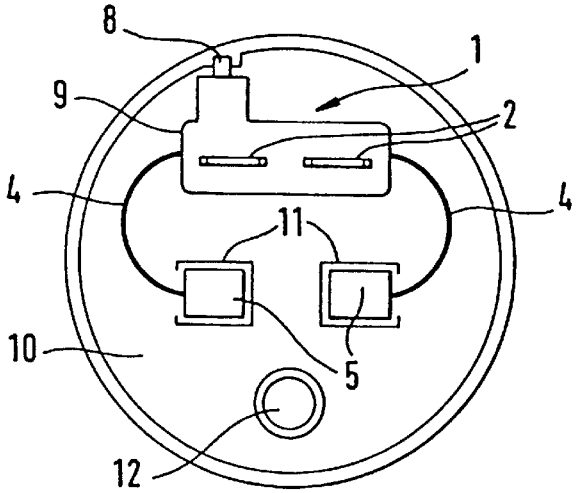
FIG. 3 shows a front view of a bearing plate with the connector for a fuel pump.

FIG. 3 shows a bearing plate 10 of a fuel pump with an outlet 12 for the fuel which is to be fed. The connector 1 is plugged onto the bearing plate 10, after assembly. The metal spring 8 rests against the edge of the bearing plate 10. The ground contact is thus produced when the bearing plate 10 is fitted to the metallic housing of the fuel pump. The carbon brushes 5 are mounted, such that they can move, in the receptacles 11 in the bearing plate 10, in such a manner that they can move downward in the event of wear resulting from the electric motor, which is not illustrated but is arranged under the bearing plate 10.

What is claimed is:

1. A connector for a fuel pump which is arranged in a fuel tank of a motor vehicle comprising:

(a) electrical components, including electrical contact pins, coils, braids, a capacitor and a ground contact;

(b) electrical connecting points between each of the electrical components providing for the flow of electricity there between; and (c) a coating of polyoxymethylene extruded to cover only the electrical connecting points to protect the points against fuel corrosion, the coating having recesses that expose the coils in the regions of their turns.

2. The connector as defined in claim 1 wherein the braids are extrusion coated without any prior treatment.

3. The connector as claimed in claim 2, characterized in that before being extrusion coated, the braids (4) are mechanically compressed in the region of the extrusion coating.

4. The connector as claimed in claim 3, characterized in that a sealing element is arranged around the braids (4), in the region of the extrusion coating.

5. The connector as claimed in claim 4, characterized in that the sealing element is a shrink sleeve.

* * * * *